United States Patent [19]

Smith

[11] 4,318,711

[45] Mar. 9, 1982

[54] CONVERTING LOW BTU GAS TO HIGH BTU GAS

[75] Inventor: Robert H. Smith, Plano, Tex.

[73] Assignee: Atlantic Richfield Company, Los Angeles, Calif.

[21] Appl. No.: 108,102

[22] Filed: Dec. 28, 1979

[51] Int. Cl.[3] ..... C10K 3/04

[52] U.S. Cl. ..... 48/197 R; 48/203; 518/705

[58] Field of Search ..... 518/705; 48/197 R, 203; 260/449 M, 449.6 M; 423/658, 415 A

[56] References Cited

U.S. PATENT DOCUMENTS 983,199 1/1911 Bedfad et al. ..... 260/449 M 3,442,619 5/1969 Huebler et al. ..... 423/658

3,854,895 12/1974 Muller ..... 260/449 M

*Primary Examiner*—Peter F. Kratz

*Attorney, Agent, or Firm*—M. David Folzenlogen

[57] ABSTRACT

Low BTU feed gas formed by gasification of carbonaceous materials with air is converted to high BTU gas by partial carbon monoxide separation and by using the reducing characteristic of the remaining feed gas in the iron reduction unit of a standard iron-steam process for manufacturing hydrogen. The hydrogen manufacturing stage also removes nitrogen which is a primary cause of low heat value in upgraded gases. The separated CO and the manufactured $H_2$ are converted to a high quality methane. In the process, other undesirable impurities and diluents like hydrogen sulfide and carbon dioxide may be removed first.

2 Claims, 1 Drawing Figure

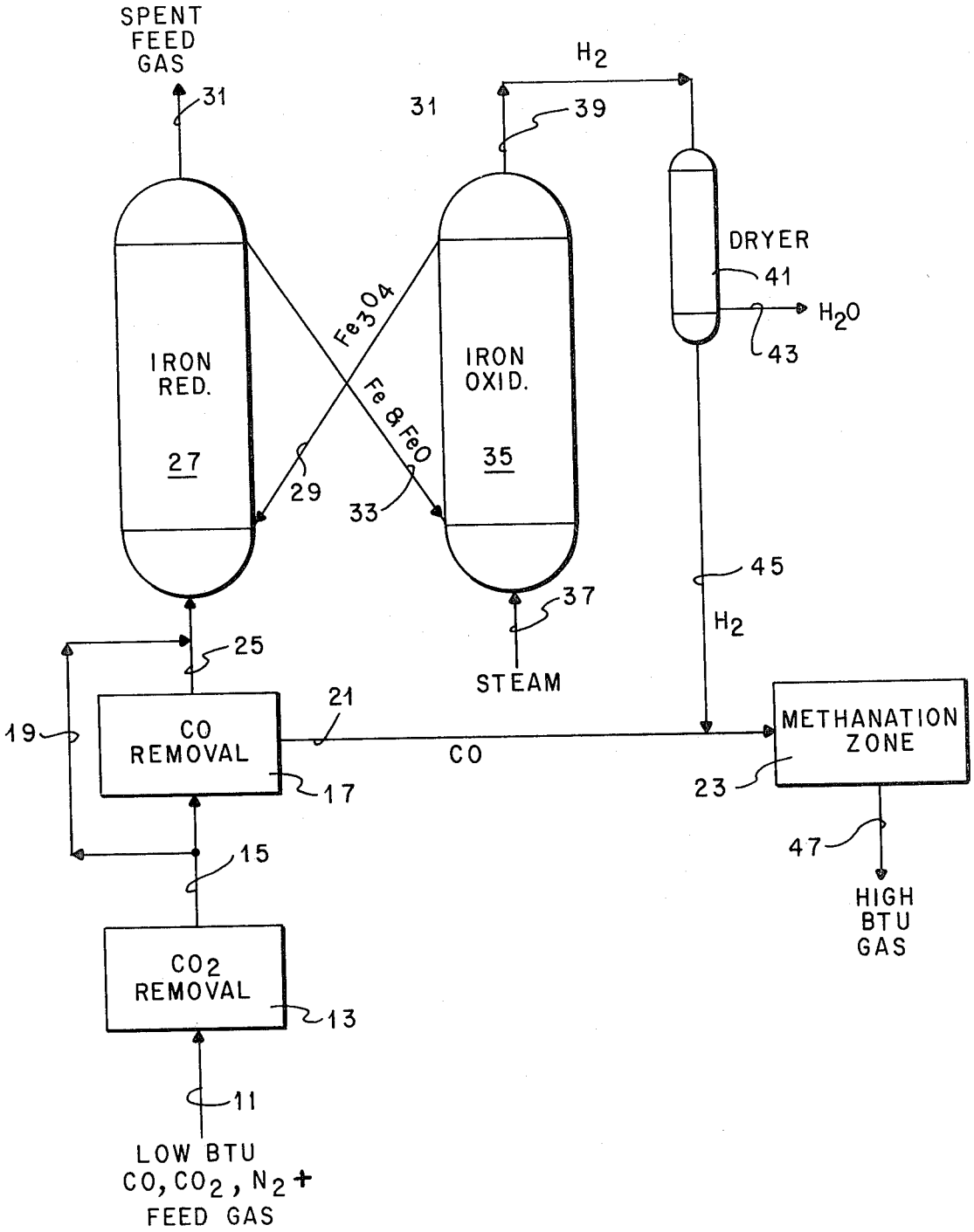
SPENT FEED GAS
31
31
$H_2$
39
DRYER
41
$H_2O$
43
IRON RED.
27
$Fe_3O_4$
Fe & FeO
IRON OXID.
35
29
33
45
37
$H_2$
25
STEAM
21
19
CO REMOVAL
CO
METHANATION ZONE
17
23
47
15
HIGH BTU GAS
$CO_2$ REMOVAL
13
11
LOW BTU
$CO, CO_2, N_2$ +
FEED GAS

CONVERTING LOW BTU GAS TO HIGH BTU GAS

BACKGROUND OF THE INVENTION

This invention is concerned with economically converting low BTU gas to high BTU gas. More particularly, methane is produced by reacting carbon monoxide separated from purified low BTU gas with hydrogen produced by the steam-iron process using the deoxidizing properties of the low BTU gas. This also removes nitrogen from the final product.

This disclosure relates to a process for producing methane from a low BTU gas containing hydrogen, carbon monoxide, nitrogen and relatively small amounts of the other materials found in the gas produced by the gasification of carbonaceous materials with air. This gaseous product is sometimes called producer gas. By way of example, a producer gas produced from the gasification of coal with air may contain on a dry basis 15% hydrogen, 29% carbon monoxide, 50% nitrogen, 5% carbon dioxide and 1% methane.

The shortage of natural gas, which is predominantly methane, has greatly increased the need for economic production of synthetic natural gas. Gasification of carbonaceous materials, for example coal, produces a low BTU gas generally having a fuel value below 300 BTU/std. $ft^3$ which is too low for most natural gas uses. Methane has a heat of combustion of 1013 BTU/$ft^3$. A large number of processes have been proposed for enhancing the heat value of low BTU gases. Many of these processes produce what is called an intermediate BTU gas because the final product is diluted with low heat value gases. Low BTU gases lack sufficient hydrogen. The economics of converting low BTU gases to methane is affected by the cost of hydrogen and process steps required to produce a good quality methane gas. This is affected by the purity of the various reaction streams and final product.

Accordingly, it is an object of this invention to provide a method of producing a high BTU product in a way that effectively uses the carbon monoxide in the feed gas and the remaining low BTU gas to reduce the cost of producing hydrogen in a way that produces a final pipeline product that requires no further treatment other than water removal.

SUMMARY OF THE INVENTION

A low BTU feed gas comprised predominantly of carbon monoxide, hydrogen and nitrogen is processed to produce a high BTU methane-rich gas. The feed gas is divided into two streams. One stream is passed to the reducing stage of an iron-steam generation process. The other stream is treated to removed carbon monoxide which is used as one of the reactants in a CO—$H_2$ methanator. After CO removal the remaining $H_2$—$N_2$ feed gas is also passed to the iron oxide reduction unit. Nitrogen, the major undesirable diluent, is removed at the hydrogen production stage of the process. Hydrogen produced in the iron oxidation stage of the process is used as the other reactant in the methanator. Water produced in the methanator is easily removed. This process, therefore, produces a methane product suitable for use as natural gas in few steps with efficient use of the unreacted part of the low BTU feed gas and with efficient nitrogen removal. When present, undesirable impurities and diluents like hydrogen sulfide, and carbon dioxide may be removed first.

BRIEF DESCRIPTION OF THE DRAWING

The drawing is a schematic representation of a process for converting low BTU gas to high BTU gas with impurity and partial carbon monoxide separation and with efficient utilization of the remaining feed gas.

DETAILED DESCRIPTION

The following description is concerned with a particular sequence of known process stages to economically produce high BTU gas from low BTU gas comprised predominantly of CO, $H_2$ and $N_2$. Since low BTU gases derived from coal and some other carbonaceous fuels contain $H_2S$ and $CO_2$, the process hereinafter described in detail will also allow for the presence of these unwanted materials. Accordingly as shown in the drawing, a low BTU feed gas comprised of CO, $CO_2$, $H_2S$, $H_2$ and $N_2$ in line 11 is passedthrough impurity removal zone 13 where acid gases and other impurities are removed from the feed gas without significant removal of carbon monoxide and hydrogen in the feed gas. Otherwise, any conventional $H_2S$ and $CO_2$ removal process may be used. For example, absorption, chemical conversion, or a combination thereof, with di- or monoethanolamine, hot potassium carbonate, propylene carbonate, tetrahydrothiophene dioxide and alkanolamine, or polyglycol-ether.

After acid gas removal, the remaining feed gas is divided into two streams. One stream is passed through line 15 to carbon monoxide removal and recovery zone 17 where carbon monoxide is separated from the feed gas to produce a CO-rich stream in exit line 21 and an $H_2$—$N_2$-rich stream in exit line 25. Any suitable conventional process may be used for separating the carbon monoxide from the low BTU feed gas. Cryogenic cooling or physical absorption with copper ammonium acetate or cuprous aluminum chloride solutions in an absorption column may be employed. Generally, absorption is carried out at temperatures below 100° F. and pressures between 50 to 60 atmospheres. After absorption, heating (for example to 170° F.) and changing the pressure (for example, 50 or more atmospheres) of the copper liquor releases a relatively high quality carbon monoxide. After the desorption step, the resulting CO-rich stream in line 21 is passed to methanation zone 23.

As shown, the other stream of feed gas bypasses the CO-removal and recovery zone through bypass line 19 where it is combined with the $H_2$—$N_2$-rich stream in line 25 and is passed into iron oxide reduction unit 27. In the iron reduction unit, these combined streams react with particles of iron oxides fed into the unit through line 29. The reducing reaction may be conducted at atmospheric pressure or any desired higher pressure. For the process of this invention it is preferred that iron oxide be reduced to free metal without the formation of iron carbides or free carbon. The preferred reactions are as follows:

$$Fe_3O_4 + 4CO \rightarrow 3Fe + 4CO_2 \quad (1)$$

$$FeO + CO \rightarrow Fe + CO_2 \quad (2)$$

The hydrogen in the combined streams is also effective in reducing iron oxides to iron. This provides better balance between the hydrogen produced in a subsequent iron oxidation unit and the carbon monoxide previously separated and passed to the methanation zone. Moreover, in the oxidizing unit, carbides and carbon would react to form methane and the oxides of carbon. These oxides would need to be removed. Higher temperatures, for example 1100° F. and above, favor the formation of free iron and carbon dioxide in the reducing unit while lower temperatures like 850° F. to 1000° F. favor carbide and carbon formation.

In the reducing unit, the iron oxide particles, for example 20 mesh and smaller, and reducing gas are reacted preferably at a temperature of between 1100° F. and 1650° F. for sufficient time to reduce the iron oxides to free iron and lower oxides. These reactions except for the reduction of oxides with hydrogen are exothermic and require no additional heat. The upper part of the reduction unit is usually hotter than the lower part. For illustrative purposes, the reduction unit is shown as a continuous flow system, but a batch system may be used. The reducing feed gas passes upward through iron oxide solids and the spent feed gas which is predominantly nitrogen and carbon dioxide is removed overhead through vent line 31.

The reduced iron and iron oxide exits the reduction unit through line 33 and is passed into iron oxidizing unit 35 where it is reacted with steam introduced into the bottom of the oxidizing unit through steam inlet line 37. In this unit, the reduced iron oxide and free iron react with steam to form higher oxides of iron and hydrogen in accordance with the following reactions:

$$Fe + H_2O \rightarrow FeO + H_2 \quad (3)$$

$$3FeO + H_2O \rightarrow Fe_3O_4 + H_2 \quad (4)$$

Other reactions will occur. For example, some $CO_2$ carried over with reduced iron particles from the reduction unit may react with free iron to form iron oxide and carbon monoxide as follows:

$$Fe + CO_2 \rightarrow FeO + CO \quad (5)$$

The carbon monoxide may then react with free iron and hydrogen or with hydrogen to form methane and iron oxide as follows:

$$Fe + CO + 2H_2 \rightarrow CH_4 + FeO \quad (6)$$

$$2H_2 + 2CO \rightarrow CH_4 + CO_2 \quad (7)$$

By the same token, the carbon dioxide may react with free iron and hydrogen to methane and iron oxide as follows:

$$2Fe + CO_2 + 2 \rightarrow CH_4 + 2FeO \quad (8)$$

Reactions 3, 4, 6, 7 and 8 are exothermic. This plus the low cost of iron illustrates the special utility of using iron to produce hydrogen. The hydrogen is removed overhead through line 39 where it is passed through dryer 41 to remove water through line 43. The dried hydrogen is then passed through line 45 to be combined with the carbon monoxide in Line 21 in the appropriate $H_2/CO$ ratio, for example 3.0, for reaction in methanation zone 23 to produce $CH_4$-rich product gas in line 47. Generally, it will be unnecessary to purify the hydrogen gas of other gases before introduction into the methanation zone.

In the methanation zone, therefore, a high BTU single product methane gas and water is produced in product line 47. The water is readily removed. Any conventional single or multiple stage process for forming methane from carbon monoxide and hydrogen may be used. In this process, since the reactants are of high quality and in the appropriate ratio, methane may readily be formed in one stage. Multiple beds may be used for temperature control. As used herein, methanation is a catalytic reaction between carbon monoxide and hydrogen to produce methane according to the following equation:

$$CO \rightarrow 3H_2 \rightarrow CH_4 + H_2O + \text{heat} \quad (1)$$

Much has been written on this process. The process is typically carried out by passing the gaseous reactants through a bed of catalyst, for example, nickel or nickel alloyed with platinum, or by fluidizing the catalyst at temperatures between 600° and 1300° F. and at pressures above 200 psig. Space velocities vary over a wide range, for example, between 1800 and 12,000 v/v/hr.

EXAMPLE

A low BTU feed gas is processed in accordance with the process of this invention with initial $CO_2$ removal zone 13 with the results shown in Table 1.

TABLE 1

| Line No. | Moles Per Hr. | Mole Percent | | | | | |
|---|---|---|---|---|---|---|---|
| | | $N_2$ | CO | $CO_2$ | $H_2$ | $CH_4$ | $H_2O$ |
| 11 | 46.8 | 46.8 | 17.5 | 13.0 | 21.0 | 1.7 | — |
| 15 | 87.65 | 53.4 | 20.0 | 0.7 | 24.0 | 1.9 | — |
| 21 | 7.38 | — | 100 | — | — | — | — |
| 25 | 80.27 | 58.3 | 12.6 | 0.8 | 26.2 | 2.1 | — |
| 31 | 80.27 | 58.3 | 3.7 | 9.8 | 7.5 | 2.1 | — |
| 37 | 80.01 | — | — | — | — | — | 100 |
| 39 | 80.01 | — | — | — | 28.6 | — | 71.4 |
| 45 | 22.86 | — | — | — | 100 | — | — |
| 47 | 15.92 | — | 0.002 | 1.4 | 10.0 | 45.0 | 43.6 |

After removing the water, the final pipeline gas is 79.7 mol percent methane, 17.8 mol percent hydrogen, 2.4 mol percent carbon dioxide, and 0.003 mol percent carbon monoxide.

Reasonable variations and modifications are practical within the scope of this disclosure without departing from the spirit and scope of the appended claims.

The embodiments of the invention in which an exclusive property or privilege is claimed are defined as follows:

1. A process for producing a higher BTU gas from a lower BTU feed gas comprised of $H_2$, CO and $N_2$, said process comprising:

(a) dividing said feed gas into a first feed gas stream and a second feed gas stream;

(b) removing CO from said second feed gas stream to produce a CO-rich gas substantially free of hydrogen and nitrogen and an effluent gas containing nitrogen and hydrogen;

(c) passing CO-rich gas produced in step (b) to a methane forming reaction zone;

(d) passing said first feed gas stream and said effluent gas produced in step (b) as reducing gas through an iron oxide reduction zone to produce a reduced form of iron and a spent reducing gas, separating the reduced form of iron from the spent reducing gas and then;

(e) reacting at least a part of the reduced form of iron with steam to form a $H_2$-rich gas substantially free of nitrogen;

(f) passing $H_2$-rich gas formed in step (e) to a methane forming reaction zone, and (g) reacting said CO-rich gas of step (c) and said $H_2$-rich gas of step (f) in said methand forming reaction zone to produce a $CH_4$-rich gas.

2. In the process of claim 1 wherein the feed gas contains $CO_2$ and prior to step (a), said feed gas is passed through a $CO_2$ removal zone to remove at least a part of said $CO_2$.

* * * * *